US006227335B1

(12) United States Patent
Koeppe, Jr. et al.

(10) Patent No.: US 6,227,335 B1
(45) Date of Patent: May 8, 2001

(54) ELEVATOR CAR OPERATING PANEL

(75) Inventors: Robert J. Koeppe, Jr., Newton; Miles P. Lamb, Chester, both of NJ (US)

(73) Assignee: Invento AG, Hergiswil (CH)

( * ) Notice: Subject to any disclaimer, the term of this patent is extended or adjusted under 35 U.S.C. 154(b) by 0 days.

(21) Appl. No.: 09/460,328

(22) Filed: Dec. 10, 1999

(51) Int. Cl.[7] ..... B66B 3/00
(52) U.S. Cl. ..... 187/414; 187/395
(58) Field of Search ..... 187/395, 396, 187/414; 348/734; 200/520, 530, 532

(56) References Cited

U.S. PATENT DOCUMENTS

| | | | | |
|---|---|---|---|---|
| 1,086,527 | * | 2/1914 | Hamilton et al. | 187/396 X |
| 1,261,985 | * | 4/1918 | Wheeler | 187/395 |
| 2,998,500 | * | 8/1961 | Di Carlo | 187/414 X |
| 4,019,607 | * | 4/1977 | Mandel et al. | 187/395 |
| 4,022,296 | * | 5/1977 | Mandel et al. | 187/395 |
| 4,963,876 | * | 10/1990 | Sanders et al. | 341/176 |
| 5,063,484 | * | 11/1991 | Takana | 362/109 |
| 5,422,783 | * | 6/1995 | Darbee | 361/680 |
| 5,490,581 | * | 2/1996 | Warner et al. | 187/414 |
| 5,507,366 | * | 4/1996 | Huang | 187/395 |
| 5,515,052 | * | 5/1996 | Darbee | 341/176 |
| 5,568,367 | * | 10/1996 | Park | 200/314 |
| 5,889,240 | | 3/1999 | Purosto et al. | 187/395 |
| 6,029,778 | * | 2/2000 | Lacarte Estallo | 187/414 |

FOREIGN PATENT DOCUMENTS

| | | | | |
|---|---|---|---|---|
| 4312844 | | 10/1994 | (DE) | G06F/3/023 |
| 108407 | | 5/1984 | (EP) | B66B/1/46 |
| 841673 | | 5/1998 | (EP) | H01H/13/14 |
| 2659636 | | 9/1991 | (FR) | B66B/3/00 |
| 3-182481 | * | 8/1991 | (JP) | 187/395 |
| 3-195677 | * | 8/1991 | (JP) | 187/395 |
| 3-293279 | * | 12/1991 | (JP) | 187/414 |
| 4-272084 | * | 9/1992 | (JP) | 187/395 |
| 6-72669 | * | 3/1994 | (JP) | 187/395 |
| WO 94/01844 A1 | * | 1/1994 | (WO) . | |

* cited by examiner

*Primary Examiner*—Eileen D. Lillis
*Assistant Examiner*—Thuy V. Tran
(74) *Attorney, Agent, or Firm*—Schweitzer Cornman Gross & Bondell LLP

(57) ABSTRACT

An elevator car operating assembly is of a modular construction which allows customization of the assembly for a given installation. An inner frame is provided upon which the car operating controls are mounted. The inner frame is constructed to mount a variety of controls in predetermined positions. The controls are mounted thereon as appropriate for the elevator installation. A circuit board mounts to a rear face of the inner frame, and interfaces with the controls assembled on the inner frame. The circuit board preferably is pre-fabricated to interface with each operating control which can be mounted to the inner frame. An insert is located on a front face of the inner frame. The insert is customized to the installation, and has apertures aligned with the operating controls utilized; the remaining component-mounting apertures on the inner panel are covered by the insert, whereby a finished appearance to the assembly is provided. An outer frame surrounds the inner frame and mounts the assembly to the elevator car wall.

6 Claims, 3 Drawing Sheets

ELEVATOR CAR OPERATING PANEL

The present invention relates to a new and improved construction for elevator car operating panels.

BACKGROUND OF THE INVENTION

Elevator car floor designation buttons and ancillary operating controls are typically mounted individually in a large metal panel located on an inner wall of the car and commonly referred to as a swing return cover. Each designation button assembly may contain its own individual circuit board, if car control is electronic, or may comprise simply a switch and indicator light if car control activation is electrical or electro-mechanical in nature. Each button, whether electronic or electrical, is individually wired to the other buttons, as well as to terminal blocks, and/or other device and hardware on the return cover. The manual wiring interconnections required are time and labor intensive, and offer many opportunities for error. In addition, great care must be taken with the wiring process to ensure solid and reliable connections and fitting.

The button and control layout, and the associated wiring for each car, is customized for the car. In the event the operating parameters for the car changes, for example by the desired inclusion of additional floor stops, a new panel must be designed and wired. Typically the old panel cannot be modified.

It is accordingly a purpose of the present invention to provide a car operating panel which allows flexibility and modularity for interconnection of individual switch buttons assemblies and other operating controls.

A further purpose of the present invention is to provide a car operating panel which can accommodate a variety of button orientations and layouts.

It is a still further purpose of the present invention to provide an elevator car operating panel which is of economical design and layout and minimizes assembly time and expense.

BRIEF DESCRIPTION OF THE INVENTION

In accordance with foregoing and other objects and purposes, an elevator car operating panel in accordance with the present invention comprises an inner panel which provides structural support and mounting provisions for the various operating button assemblies and other necessary components of the operating panel. The button assemblies, circuit boards and the like can be mounted on the inner panel in a variety of configurations, the specific arrangement and orientation of the components being appropriate for the specific car requirements. An insert is placed over the inner panel with apertures configured in the appropriate and specific configuration of the intended application. The insert provides a finished appearance for the operating panel. An outer frame surrounds the inner panel, with the insert being supported between the inner panel and outer frame.

In addition to providing a mounting surface for the operating controls, the rear side of the inner panel supports a main circuit board. The main circuit board may include switches and associated components at each location at which an operating button can be located, and is so mounted on the inner panel that there is the required interconnection between the switches on the main board and the operating buttons mounted to the inner panel. Thus, only a single master board is needed to accommodate a variety of button configurations. In addition to floor buttons, controls for other functions, such as security calling, emergency switching, fire personnel control and the like may be similarly mounted on the inner panel to interface with the corresponding switchgear and other interface components on the master board. Thus, full flexibility in layout and design is accomplished with a minimum of different components.

BRIEF DESCRIPTION OF THE DRAWINGS

A fuller understanding of the present invention will be achieved upon consideration of the following detailed description of a preferred, but nonetheless illustrative embodiment of the invention, when considered in association with the annexed drawings wherein.

DETAILED DESCRIPTION OF THE INVENTION

With reference to the figures, car operating panel 10 is constructed and adapted to be mounted upon the outer surface of an elevator car swing return cover, the return cover typically being in the form of a large metal panel. Car operating panel 10 forms a complete assembly which may be coupled to an appropriate electrical connector on the swing cover, allowing the car operating panel to be coupled to the elevator operating system. The outer frame or housing 16 of the car operating panel mates the operating panel to the swing cover. The housing may be of cast metal or another appropriate material chosen and configured to both support the operating panel and be compatible with the elevator car interior. The outer frame is mountable to the swing cover by small bolts or other fastening means as known in the art.

Figure 1:
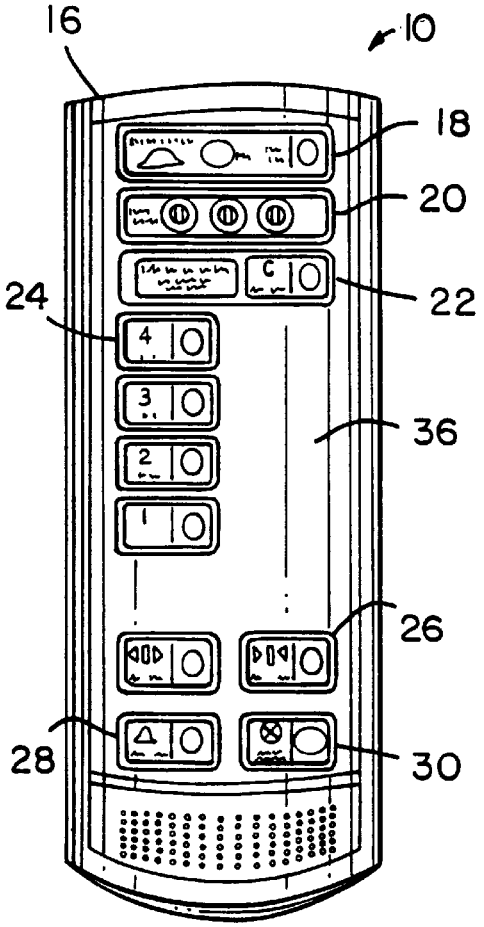
FIG. 1 is a front view of a car operating panel of the present invention.
Figure 3:
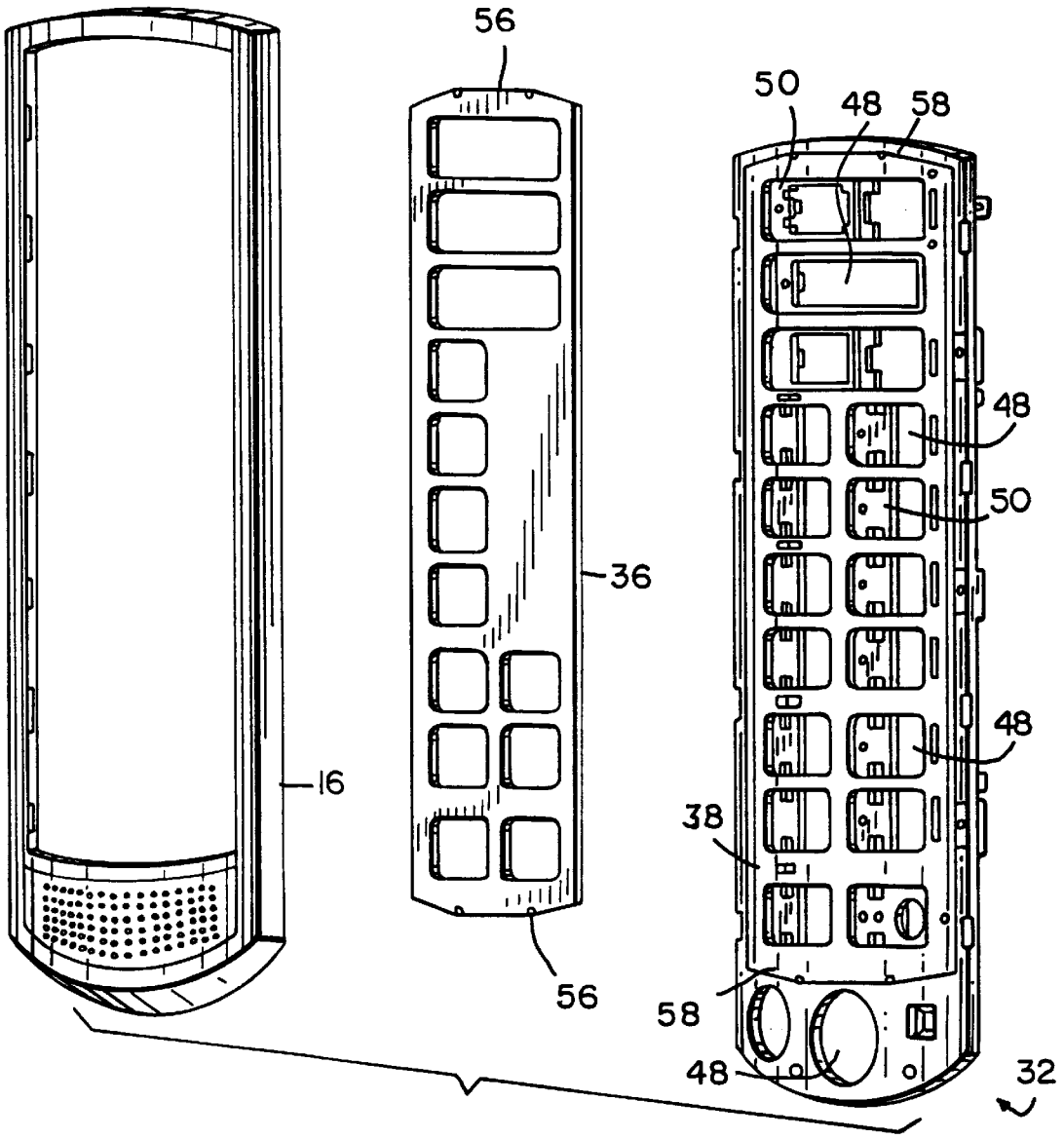
FIG. 3 is an exploded perspective view of the inner panel, insert and outer frame.

As seen in FIG. 1, the outer frame 16 surrounds a plurality of individual car operating elements and controls, such as the fireman's key and button unit 18, floor lockout key switch assembly 20, a call telephone button assembly 22, floor buttons assemblies 24, door open and close button assemblies 26, alarm button assembly 28, and emergency switch assembly 30, which are each mounted to an inner frame or panel 32 seen in FIG. 3, which cannot be seen in FIG. 1, as the frame or panel 32 is overlaid by a decorative insert 36. As shown in the figure, the floor button assemblies 24 may be arranged in a single column with a open space adjacent thereto. Alternatively, the floor button assemblies may be arranged in other configurations dependent on the number of floors controlled. Additional or fewer operating buttons and controls, as appropriate for the elevator installation, can be utilized as needed.

Figure 4:
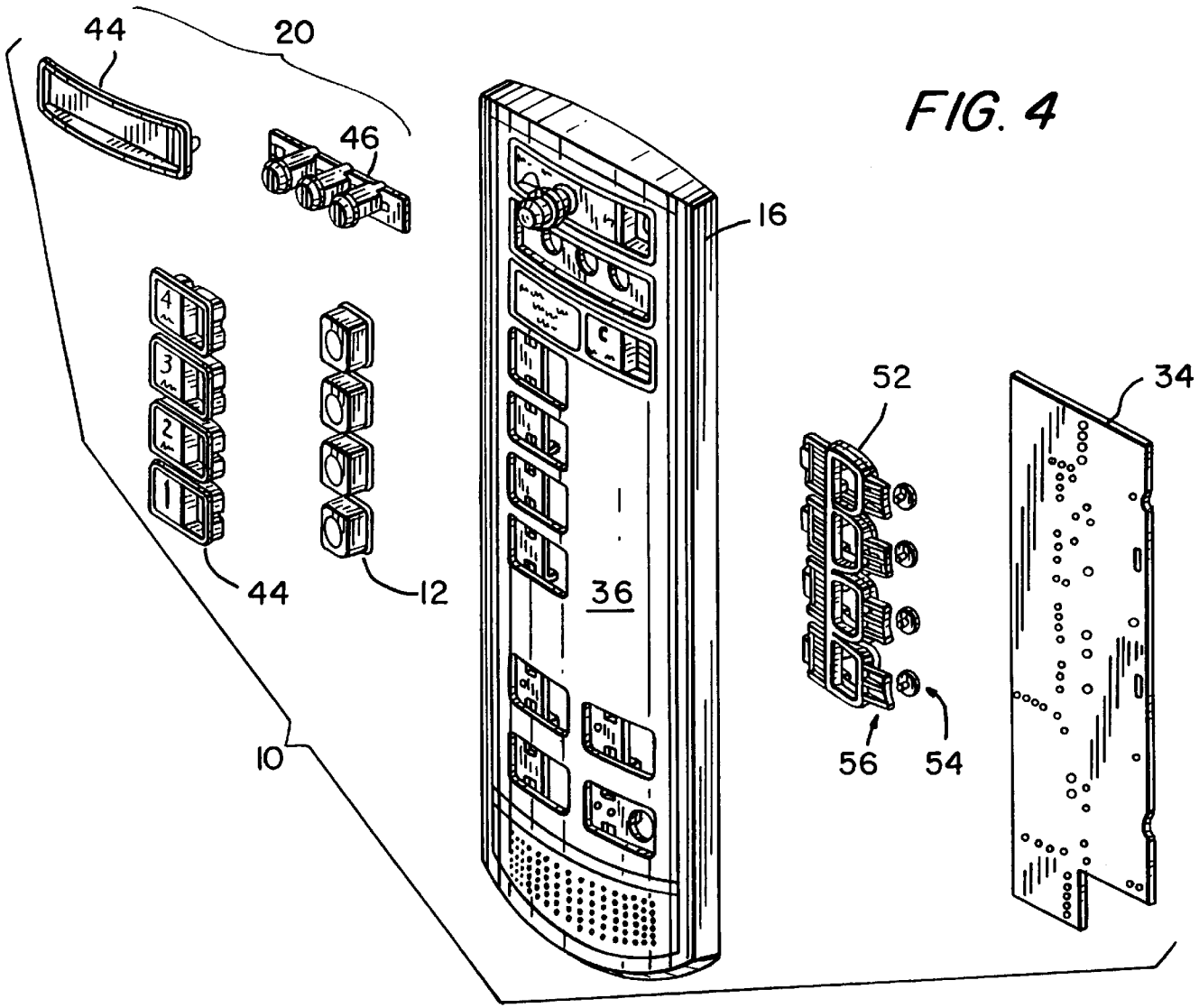
FIG. 4 is an exploded perspective view of a typical assembly of operating buttons and controls, an assembled inner panel, insert and outer frame, and a circuit board.

In accordance with modern constructions, and as seen in further detail in FIG. 3, each of the buttons 18–30 may comprise the operating button itself, a button base to which a leaf spring is mounted, and a "halo" 44. The "halo" surrounds the button proper, provides a place for mounting a braille designation as may be required, guides the operating button when operated, and provides a finished appearance around the front surface of the button. The button assembly may be tailored for the specific associated button function. Other operating controls, such as lockout key switch assemblies 20 detailed in FIG. 4, are similarly configured with a halo mount 44 to support the movable operable elements, such as the key lock unit 46 and contour the assembly as required.

Figure 2:
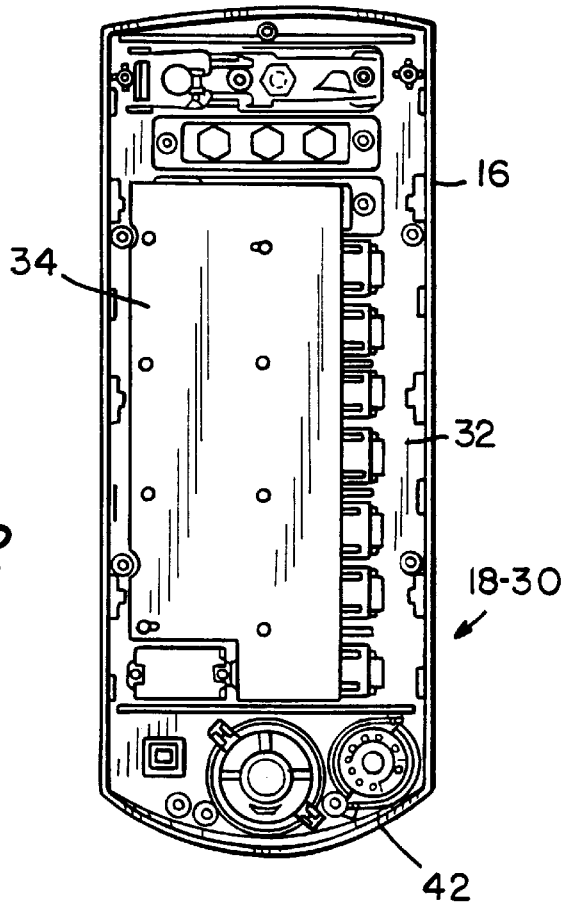
FIG. 2 is a rear view thereof.

FIG. 2 presents a rear view of the operating panel 10. The inner frame or panel 32, typically constructed of an appropriate plastic, can be seen as sitting within the outer frame 16, providing the mounting surface for the individual button and control assemblies 18–30, as well as a speaker and microphone assembly 42. With further reference to FIG. 4, the inner panel 32 may include a series of apertures 48 of various sizes into which the button and control assemblies are mounted by a snap-type fit utilizing integral connectors 50 formed into the inner panel which engage corresponding connectors formed as part of the button and control assemblies. Alternatively, the switch and control assemblies may be mounted to the inner panel with discrete fasteners, such as nuts and bolts or rivets. As shown in FIG. 3, the inner panel preferably has the mounting apertures 48 laid out to accept a variety of button and control assembly configurations, with the button and control assemblies being of common dimensions to allow flexibility in positioning upon the inner panel in accordance with general layout guidelines and conventions. The inner panel, with the button and control assemblies mounted thereto, in the desired and required locations, forms an integral subassembly which may be assembled at the factory in a convenient and economical manner.

Circuit board 34 is mounted to the rear face of inner panel 32 by spacer/connectors as known in the art. In a preferred embodiment, the circuit board 34 may be positioned to overlie at least the floor operating button assemblies 24. The printed circuit board includes electrical switches and light-emitting diode assembles oriented and arranged on the board to interface with the floor operating buttons such that when an operating button is depressed, its spring-actuated plunger activates the corresponding switch on the circuit board. As known in the art, such actuation may be mechanical, magnetic, or the like. The printed circuit board can also provide interface circuitry for the remaining switches on the inner panel which may be connected to the printed circuit board with prefabricated wiring harnesses or connectors. As shown in FIG. 4, plunger assemblies 52, which are mounted to the back surface of the inner panel 32, may include contacts 54 which engage corresponding contact sets 56 on printed circuit board 34.

The printed circuit board may preferably be fabricated in an economical manner to accommodate a variety of features, the features being implemented through the connection of the board to the appropriate switch through a wire harness. For example, the board may be fabricated to accommodate a chosen number of floor buttons arranged in a particular pattern. If a particular car configuration requires fewer floor buttons, the additional switches on the printed circuit are not utilized, as there will be no corresponding button assembly installed on the inner panel to activate the switch. In a similar manner, a full array of features may be provided for on the main board, the features being utilized only as needed when a corresponding switch is provided on the inner panel. While such a methodology provide a small amount of increased cost to the incorporation of possibly unused components, such cost is more than compensated for by the decrease in costs and inventory required and associated with a need for customized board assemblies.

The circuit board 34 may also include a primary cable and/or connector (not shown) to allow interface between the operating panel and the appropriate connector on the swing cover. As known in the art, such connection would also provide appropriate power and ground connections.

As further shown in FIGS. 3 and 4, decorative metal insert 36 is located upon the outer front face of the inner panel 32 to provide a finished appearance for the operating panel. The metal insert is manufactured specific to the intended construction and layout of the operating panel, having apertures aligned with the button and control assemblies actually utilized and mounted on the inner panel, with an otherwise solid appearance overlying the remaining portions of the panel. Accordingly, while the inner panel 32 can be configured in a variety of patterns for a broad range of applications, the metal insert 36 provides a customized, application-specific appearance for the operating panel.

As further depicted in FIG. 3, the inner frame 32 may be formed with a recessed front surface portion 38 surrounded by an integral bezel-like edge portion 40. The metal insert 36 provides a frictional fit within the recess. Locating pins 56 and bores 58 may assist in retaining the insert. Alternatively, the outer frame 16 may be formed with a peripheral lip which allows the front metal insert 36 to be retained between the lip and the inner panel 32. The inner panel 32 may be retained within the frame by integral fasteners or individual fastening means, such as locking screws, as known in the art, forming a sandwich-like construction.

Because of its modular type construction, the car operating panel in accordance with the present invention may be of compact size, and may measure approximately 9 inches by 24 inches, whereas a traditional car operating panel having an equivalent number of operating buttons may occupy a space of 16 inches by 84 inches or greater. The reduced size translates into both reduced cost and decreased assembly time. Because circuit board 34 may be fully populated, the amount of discrete wiring required is substantially reduced. This further translates into increased reliability and reduced assembly cost.

Inclusion of the metal insert 36 permits a common inner panel and printed circuit board for a plurality of applications. It further reduces factory rework in the event the operating button layout is improper, as in such case only the insert having the improper punching needs to be discarded.

We claim:

1. A modular elevator car operating panel assembly adapted to accommodate a variety of operating button orientations and layouts, comprising: an inner frame; a plurality of car operating controls, including floor button assemblies, mounted to the inner frame; a main printed circuit board mounted to a rear face of the inner frame and bearing components to interface with said car operating controls and means for coupling the car operating controls to a remote car control system; an insert located on a front face of the inner frame and having a plurality of individual apertures through a solid face, each of said apertures being aligned with one of the car operating controls whereby the one car operating control is accessible within the aperture and the locations on the inner frame not occupied by operating controls are covered by the solid face of the insert LOCATIONS; and an outer frame supporting the inner frame and mountable to an elevator car surface.

2. The elevator car operating panel assembly of claim 1 wherein the inner frame has a plurality of apertures each adapted to accept for independent mounting one of said in a discrete position, said printed circuit board bearing components to interface with the car operating controls located at each of said discrete positions.

3. The elevator car operating panel assembly of claim 2 wherein said floor button assemblies each comprise a button, an actuator spring and a halo, said printed circuit board components interfacing with the button assemblies comprising a switch.

4. The elevator car control panel of claim 2 wherein the front face of the inner frame includes a peripheral recess to accept the insert.

5. An elevator car operating panel assembly, comprising an inner frame adapted to support a plurality of car operating controls, the inner frame having apertures for mounting the car operating controls at predetermined locations upon the inner frame; at least one car operating control mounted upon the inner frame and extending forwardly thereof; an insert positioned upon a front face of said inner frame the insert having apertures for acceptance of the at least one car operating control mounted upon the main frame and having an overlying surface covering the vacant apertures of the inner frame; a circuit board mounted to a rear face of the inner frame and having electrical components positioned to couple at least the at least one car operating control mounted upon the inner frame to an elevator operating system; and an outer frame surrounding the inner frame for mounting the car operating panel assembly upon an elevator inner wall surface.

6. The elevator car operating panel assembly of claim 5, wherein the electrical components of the circuit board are positioned to couple car operating controls mounted at each of the predetermined locations upon the inner frame.

* * * * *